US012601033B2

(12) United States Patent
Hirota et al.

(10) Patent No.: US 12,601,033 B2
(45) Date of Patent: Apr. 14, 2026

(54) RECYCLING METHOD FOR HEAVY RARE EARTH ELEMENT AND RECYCLING METHOD FOR RARE EARTH MAGNET

(71) Applicant: SHIN-ETSU CHEMICAL CO., LTD., Tokyo (JP)

(72) Inventors: Koichi Hirota, Echizen (JP); Eiichiro Iwano, Echizen (JP); Kazuaki Sakaki, Awara (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 463 days.

(21) Appl. No.: 18/250,499

(22) PCT Filed: Oct. 14, 2021

(86) PCT No.: PCT/JP2021/038100
§ 371 (c)(1),
(2) Date: Apr. 25, 2023

(87) PCT Pub. No.: WO2022/091801
PCT Pub. Date: May 5, 2022

(65) Prior Publication Data

US 2023/0399721 A1 Dec. 14, 2023

(30) Foreign Application Priority Data

Nov. 2, 2020 (JP) ..... 2020-183808

(51) Int. Cl.
*C22B 59/00* (2006.01)
*C22B 1/02* (2006.01)
(Continued)

(52) U.S. Cl.
CPC ..... *C22B 59/00* (2013.01); *C22B 1/02* (2013.01); *C22B 1/24* (2013.01); *C22B 9/003* (2013.01); *C25C 5/04* (2013.01)

(58) Field of Classification Search
CPC .. C22B 59/00; C22B 1/02; C22B 1/24; C22B 9/003; C22B 9/006; C22B 9/20;
(Continued)

(56) References Cited

U.S. PATENT DOCUMENTS

2010/0314260 A1 12/2010 Fujita et al.

FOREIGN PATENT DOCUMENTS

JP 62-146290 A 6/1987
JP 01116038 A * 5/1989
(Continued)

OTHER PUBLICATIONS

JPH01116038A Translation (Year: 1989).*
(Continued)

*Primary Examiner* — Danielle M. Carda
(74) *Attorney, Agent, or Firm* — Oblon, McClelland, Maier & Neustadt, L.L.P.

(57) ABSTRACT

A method for collecting a heavy rare earth element from a molten salt electrolysis residue and recycling the heavy rare earth element that includes mixing coarse particles of the molten salt electrolysis residue with a fluorinating material followed by firing to fluorinate the coarse particles, pulverizing the fluorinated coarse particles to obtain a powder, and mixing the powder with R, an R-M alloy, or an R-M-B alloy, where R is a rare earth element selected from Y, La, Ce, Nd, Pr, Sm, Gd, Dy, Tb, and Ho, M is a transition metal such as Fe or Co, and B is boron, heating and melting the mixture, separating a molten alloy from slag, and selectively extracting the heavy rare earth element into the molten alloy. The method can efficiently recycle a heavy rare earth element in an alloy form, useful for recycling a rare earth magnet.

12 Claims, 3 Drawing Sheets

(51) Int. Cl.
*C22B 1/24* (2006.01)
*C22B 9/00* (2006.01)
*C25C 5/04* (2006.01)

(58) Field of Classification Search
CPC ..... C22B 7/002; C22B 7/005; C22B 9/10; C25C 5/04; C25C 3/34; C25C 7/06; B09B 3/40; B22F 2202/05; B22F 8/00; H01F 41/0253; H01F 41/0293; Y02P 10/20; C22C 1/02; C22C 28/00
USPC ..... 75/10.14
See application file for complete search history.

(56) References Cited

FOREIGN PATENT DOCUMENTS

| | | | |
|---|---|---|---|
| JP | 8-31624 | A | 2/1996 |
| JP | 2001-335852 | A | 12/2001 |
| JP | 2003-113429 | A | 4/2003 |
| JP | 2010-285680 | A | 12/2010 |
| JP | 2014-51731 | A | 3/2014 |
| JP | 2015-120973 | A | 7/2015 |

OTHER PUBLICATIONS

Takeda et al., "Recycling of Rare Earth Magnet Waste by Removing Rare Earth Oxide with Molten Fluoride," The Mining and Materials Processing Institute of Japan, vol. 55, No. 2, pp. 334-341 (Year: 2014).*

Osamu Takeda et al: "Recycling of Rare Earth Magnet Waste by Removing Rare Earth Oxide with Molten Fluoride", Materials Transactions, [Online], vol. 55, No. 2. Jan. 25, 2014, pp. 334-341, XP093216477, JP ISSN: 1345-9678.

International Search Report issued Nov. 16, 2021 in PCT/JP2021/038100 filed on Oct. 14, 2021, 2 pages.

* cited by examiner

-- Prior Art --

RECYCLING METHOD FOR HEAVY RARE EARTH ELEMENT AND RECYCLING METHOD FOR RARE EARTH MAGNET

TECHNICAL FIELD

The present invention relates to a method for recycling a heavy rare earth element that collects a heavy rare earth element from a molten salt electrolysis residue produced in a step of producing a rare earth magnet, and a method for recycling a rare earth magnet by using an alloy into which a heavy rare earth element is extracted by the recycling method.

BACKGROUND ART

Application of a rare earth magnet as a functional material necessary for energy-saving and enhancement in performance is broadened in wide variety of fields ranging from general household electrical appliances, such as an air conditioner, to vehicles, such as HEV and EV. The amount of produced rare earth magnet has been increased from year to year. An applied product of the rare earth magnet is recently used in a high-temperature environment, and therefore higher heat resistance is required for the rare earth magnet.

A general rare earth magnet is produced by finely pulverizing a raw alloy of an adjusted composition in an inert gas atmosphere, compacting and molding the alloy into a certain size under application of magnetic field, and sintering the molded body in vacuum or in an inert gas atmosphere. The produced rare earth magnet is processed into a shape of a product by machining or grinding, and then surface-treated by plating, coating, or the like, to obtain the product. The amount of in-process scrap generated in the processes (leaked powder in molding, a product with a failure in sintering or on properties, a product with a failure in processing, a product with a failure in plating, and the like) reaches ten and several percents of the initial weight of the raw material, and the amount of sludge generated in the processing and grinding processes (machining and grinding wastes) reaches several tens of percent of the raw material for the product. Therefore, recycling of rare earth element from the scrap, the sludge, and the like is considered to be an important process from the viewpoint of effective utilization of rare resource, a reduction in the amount of generated waste, and a reduction in the price of the rare earth magnet.

Furthermore, to improve the heat resistance of the rare earth magnet, addition of heavy rare earth element such as Dy or Tb is effective. For example, a high-heat-resistant rare earth magnet contains several percents of the heavy rare earth element. The heavy rare earth element is widely distributed in the crust from a geological perspective, but a production area that is profitable is biased. Therefore, there is a high risk that a raw material for the heavy rare earth element cannot be stably procured and a problem that the price of the heavy rare earth element is largely changed with the change of balance between supply and demand. Accordingly, establishment of a method for efficiently recycling the heavy rare earth element is highly required.

PTL 1 describes that a rare earth element can be collected with high efficiency by the following method. In order to remelt R—Fe—B-based rare earth magnet scrap and/or sludge (R is a rare earth element containing Y, and preferably one or more types of rare earth elements selected from the group consisting of Pr, Nd, Tb, and Dy), a raw metal containing no rare earth element among raw metals used for an R—Fe—B-based magnet is first placed in a crucible. The raw metal is heated and molten, and a raw metal containing the rare earth element, the R—Fe—B-based rare earth magnet scrap and/or sludge, and a flux containing a halide of one or two or more types of metals selected from the group consisting of an alkali metal, an alkaline earth metal, and a rare earth metal are then added in proper amounts, and molten. As an R—Fe—B-based magnet alloy, the rare earth element is collected.

PTL 2 describes a method in which a rare earth element-containing alloy such as a neodymium magnet is immersed in a molten salt to which a halide of an alkali metal or an alkaline earth metal is added to extract a rare earth element, followed by electrolyzation, and the rare earth element is collected as a metal or alloy.

A typical method for producing a heavy rare earth raw material, such as Dy and Tb, to be added for an improvement in the heat resistance of a rare earth magnet is molten salt electrolysis. In the molten salt electrolysis, a heavy rare earth fluoride, or a mixed fluoride of a heavy rare earth fluoride and an alkali metal fluoride or an alkaline earth metal fluoride is used for an electrolyte. The heavy rare earth fluoride or a heavy rare earth oxide is reduced to obtain a heavy rare earth metal or alloy. For example, PTL 3 describes a method for producing a dysprosium-iron alloy from a molten salt electrolyte containing dysprosium fluoride, lithium fluoride, barium fluoride, and calcium fluoride.

CITATION LIST

Patent Literature

PTL 1: JP 2003-113429 A
PTL 2: JP 2015-120973 A
PTL 3: JP S62-146290 A

SUMMARY OF INVENTION

Technical Problem

In the method for collecting rare earth magnet scrap in PTL 1, the metal halide is added as the flux. However, this flux is a metal halide further added as a new indirect material, but not a raw material derived from a residue. Therefore, the new indirect material to be further supplied is necessitated, and a raw material cost and an environmental impact are increased. Accordingly, the method for collecting rare earth magnet scrap in PTL 1 may further be improved in terms of economy and recycling.

In the method for collecting a rare earth element in PTL 2, rare earth magnet scrap and the alloy are returned to a molten salt electrolysis step that is a general step of producing a rare earth metal. The scrap and the like are immersed in the molten salt, and a rare earth element is extracted and collected as a metal or alloy. However, the extraction rate of light rare earth element such as Nd and Pr into the molten salt is little different from that of heavy rare earth element such as Dy and Tb into the molten salt, and therefore the light rare earth element contained in the rare earth magnet scrap and alloy, which is relatively inexpensive, is also extracted into the molten salt without distinction. In case of investigating recycling process of products which has a long production step in general, returning to an upstream step complicates a separation step, and requires a low impurity concentration for a recycled raw material. Thus, a step load on recycling may be increased to decrease profitability.

In the molten salt electrolysis step in which the raw heavy rare earth metal or alloy is produced, the fluoride or the oxide is used as a raw material. After an operation of electrolysis, a not fully reduced oxide, an oxyfluoride as a reaction product, Fe as a cathode and carbon as an anode remain as a residue in molten salt. In general, the molten salt residue is recycled as the raw material of molten salt for an electrolysis after crushing finely, burning in the air, and removing an impurity by magnetic separation. In this case, a cost of refinement that increases the purity of the molten salt residue to the same impurity concentration as that of the initial raw molten salt is required. Therefore, the purity of the molten salt residue is increased to an impurity level that industrially has no problem in the operation of electrolysis, and the molten salt residue is further mixed and diluted with the initial raw material. Thus, the molten salt residue is reused. The recycling rate of industrial molten salt is not necessarily as high as ten and several percents.

The present invention has been made in view of the above circumstances. An object of the present invention is to provide a method for recycling a heavy rare earth element in which a heavy rare earth element that is rare is efficiently extracted in a form similar to a product as much as possible, and a method for recycling a rare earth magnet by reusing a collected heavy rare earth element as a raw alloy for the rare earth magnet.

Solution to Problem

The present inventors have intensively investigated to achieve the object, and as a result, found that a heavy rare earth element can be efficiently collected as an alloy by fluorinating coarse particles of heavy rare earth element-containing molten salt electrolysis residue, pulverizing the fluorinated coarse particles into a powder, mixing the obtained powder with R, an R-M alloy, or an R-M-B alloy material (wherein R is one or more types of rare earth elements selected from the group consisting of Y, La, Ce, Nd, Pr, Sm, Gd, Dy, Tb, and Ho, M is a transition metal such as Fe or Co, and B is boron), and heating and melting the mixture. The present invention has been completed.

Specifically, the present invention provides a following method for recycling a heavy rare earth element from heavy rare earth element-containing molten salt electrolysis residue, and for recycling a rare earth magnet using an alloy into which a heavy rare earth element is extracted by the recycling method.

[1] A method for collecting a heavy rare earth element from a heavy rare earth element-containing molten salt electrolysis residue and recycling the heavy rare earth element, the method including:

a step of mixing coarse particles of the heavy rare earth element-containing molten salt electrolysis residue with a fluorinating material followed by firing, to fluorinate the coarse particles of the molten salt electrolysis residue;

a step of pulverizing the coarse particles of the fluorinated molten salt electrolysis residue to obtain a powder of the fluorinated molten salt electrolysis residue; and a step of mixing the powder of the fluorinated molten salt electrolysis residue with R, an R-M alloy, or an R-M-B alloy (wherein R is one or more types of rare earth elements selected from the group consisting of Y, La, Ce, Nd, Pr, Sm, Gd, Dy, Tb, and Ho, M is a transition metal such as Fe or Co, and B is boron), heating and melting the mixture, separating a molten alloy from slag, and selectively extracting the heavy rare earth element into the molten alloy.

[2] The method for recycling a heavy rare earth element according to [1], wherein the heavy rare earth element-containing molten salt electrolysis residue is one or more types of compounds selected from an oxide, a fluoride, and an oxyfluoride containing 50% by mass or more of one or more types of heavy rare earth elements selected from the group consisting of Dy and Tb.

[3] The method for recycling a heavy rare earth element according to [1] or [2], wherein the fluorinating material is one or more types of fluorinating materials selected from the group consisting of $NH_4F$, $NH_4FHF$, a HF gas, and a fluorine gas.

[4] The method for recycling a heavy rare earth element according to any one of [1] to [3], wherein an oxygen concentration in the coarse particles of the fluorinated molten salt electrolysis residue is 1.0% by mass or less.

[5] The method for recycling a heavy rare earth element according to any one of [1] to [4], wherein a carbon concentration in the coarse particles of the fluorinated molten salt electrolysis residue is 0.3% by mass or less.

[6] The method for recycling a heavy rare earth element according to any one of [1] to [5], wherein the heating and melting is arc melting, plasma melting, or melting by high-frequency inductive heating.

[7] The method for recycling a heavy rare earth element according to any one of [1] to [6], wherein the powder of the fluorinated molten salt electrolysis residue has an average particle diameter of 10 to 100 μm that is obtained by a laser diffraction method through air flow dispersion.

[8] The method for recycling a heavy rare earth element according to any one of [1] to [7], wherein the R, the R-M alloy, or the R-M-B alloy is waste generated in a step of producing a rare earth magnet.

[9] The method for recycling a heavy rare earth element according to any one of [1] to [7], wherein the R, the R-M alloy, or the R-M-B alloy is a sintered body generated in a step of producing a rare earth magnet.

The method for recycling a heavy rare earth element according to any one of [1] to [8], wherein the R, the R-M alloy, or the R-M-B alloy is sludge generated in a step of processing a rare earth magnet or a workpiece obtained by firing the sludge.

The method for recycling a heavy rare earth element according to any one of [1] to [7], wherein the R, the R-M alloy, or the R-M-B alloy is a waste magnet collected from an applied product of a rare earth magnet.

A method for recycling a rare earth magnet by using as a raw alloy for the rare earth magnet an alloy into which a heavy rare earth element is extracted by the method for recycling a heavy rare earth element according to any one of [1] to [11].

Advantageous Effects of Invention

The present invention can provide a method for recycling a heavy rare earth element that is capable of efficiently recycling a heavy rare earth element that is rare in an alloy form similar to a product, and a method for recycling a rare earth magnet by using an alloy obtained by the recycling method.

DESCRIPTION OF EMBODIMENTS

Figure 1:
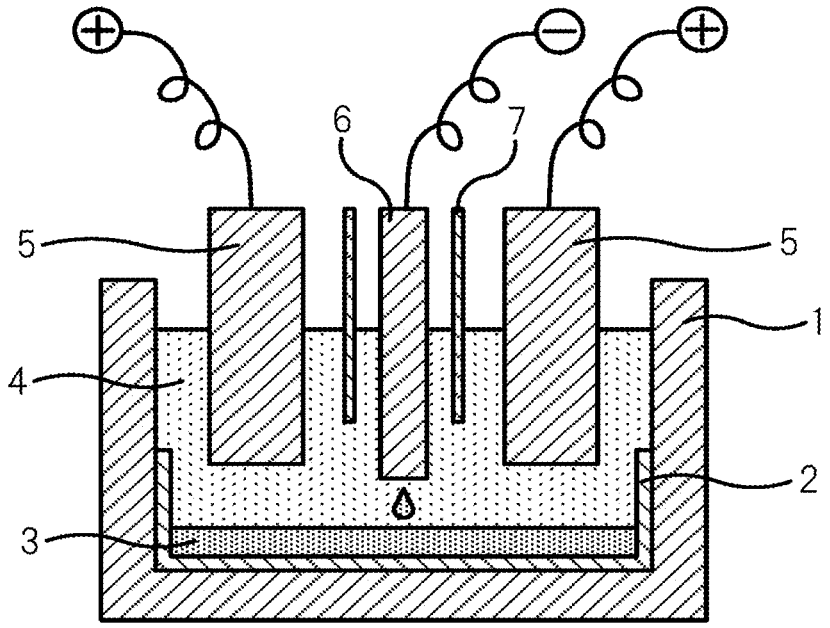
FIG. 1 is a schematic view illustrating an example of molten salt electrolysis.

A molten salt electrolysis in which a heavy rare earth element-containing molten salt electrolysis residue of the present invention (hereinafter sometimes simply referred to as molten salt electrolysis residue) is generated is publicly known molten salt electrolysis that is a method for producing a rare earth metal or a rare earth alloy. General molten salt electrolysis will be described with reference to FIG. 1.

Examples of the general molten salt electrolysis include molten salt electrolysis using a metal electrode as a cathode 6, a graphite electrode as an anode 5, and an electrolyte 4 in which a rare earth oxide is molten as a raw material with a mixed fluoride of alkali, alkaline earth, and rare earth elements. A rare earth metal is continuously deposited on a surface of the cathode by electrolytic reduction of the rare earth oxide or the fluoride at an electrolyte temperature of 700 to 1,200° C. A density of deposited rare earth metal 3 is higher than that of the electrolyte 4, and therefore the deposited rare earth metal 3 in a liquid state accumulates in a deposited metal receiver vessel 2 disposed at a bottom of a bath. The rare earth metal 3 accumulating in the deposited metal receiver vessel 2 is collected outside the system at regular intervals by using devices such as a tapping device (not shown in FIG. 1) in which vacuum suction is used. In order to suppress solidification of molten rare earth metal in the device, breakage of a suction tube, and contamination with an impurity from the suction tube during the collection, a transition metal used as a magnet raw material, such as iron, may be added to the electrolyte 4. In this case, the rare earth metal is converted into an alloy, and the melting point decreases. Therefore, the rare earth metal can be safely and efficiently collected. In case that iron electrode is used as the cathode 6, the rare earth metal deposited on the cathode is alloyed with iron of the cathode, to obtain droplets of alloy with low melting point.

A molten salt electrolysis residue is a residual left in an electrolysis vessel after an operation of the molten salt electrolysis. A molten salt electrolysis residue mainly contains a mixture of a fluoride, an oxide, and an oxyfluoride of an alkali metal, an alkaline earth metal and rare earth metal. In addition it also contains the metal as a cathode materials, the graphite (carbon) as an anode materials, structural materials of electrolysis furnace, and the like, these are mixied from an electrolyte device. A molten salt electrolysis residue preferably containing 50% by mass or more of heavy rare earth element (in particular, at least one type of rare earth element such as Dy and Tb) is suitably used. Examples of the molten salt electrolysis residue that can be suitably used in the method for recycling a heavy rare earth element of the present invention are shown in Table 1 below. Table 1 shows examples of composition of a molten salt residue generated by molten salt electrolysis using LiF-$DyF_3$ as a molten salt of an electrolyte and irons as a cathode. LiF in LiF-$DyF_3$ decreases the melting point of electrolyte of $DyF_3$, and it improves electroconductivity of electrolyte of $DyF_3$. The molten salt electrolysis residue generally contain 1 to 12% by weight of Fe and at most 1.0% by weight of carbon. The contents of composition of a molten salt residue depend on an operating condition of the molten salt electrolysis so that it cannot be specified.

TABLE 1

| Sample # | Nd (% by weight) | Dy (% by weight) | Fe (% by weight) | Other (% by weight) | F (% by weight) | O (% by weight) | C (% by weight) |
|---|---|---|---|---|---|---|---|
| 0001 | 0.0 | 68.0 | 6.8 | 2.6 | 18.3 | 4.1 | 0.2 |
| 0002 | 0.0 | 61.1 | 10.3 | 3.7 | 20.6 | 4.1 | 0.5 |
| 0003 | 0.0 | 58.0 | 7.1 | 6.7 | 22.0 | 6.0 | 0.7 |
| 0004 | 0.0 | 72.3 | 2.3 | 1.4 | 20.7 | 3.3 | 0.2 |
| 0005 | 0.0 | 68.8 | 11.5 | 3.9 | 12.9 | 2.6 | 0.3 |
| 0006 | 1.2 | 67.8 | 2.0 | 1.5 | 25.1 | 2.3 | 0.4 |
| 0007 | 4.3 | 51.8 | 7.2 | 6.8 | 24.1 | 4.9 | 0.9 |
| 0008 | 0.0 | 70.2 | 1.6 | 3.9 | 21.0 | 3.3 | 1.0 |
| 0009 | 3.5 | 55.7 | 5.6 | 6.9 | 25.3 | 2.8 | 0.5 |
| 0010 | 0.0 | 67.9 | 1.8 | 6.4 | 20.4 | 3.5 | 0.6 |

For example, the general molten salt electrolysis residue described above is subjected to the following process. Unnecessary substances such as uncollected clod metals, electrode materials, and structural material of electrolysis furnace are removed, and then the molten salt electrolysis residue is crushed into 20 mm or less by mechanical milling such as a jaw crusher, a hammer mill, or the like, to obtain coarse particles of the molten salt electrolysis residue. Subsequently, hydrochloric acid is added to the coarse particles of the molten salt electrolysis residue to leach metal elements such as Fe, and undissolved ingredients such as the rare earth fluoride and the rare earth oxyfluoride can be separated and collected. An leaching condition (hydrochloric acid concentration, leaching temperature, leaching time, etc.) is appropriately adjusted to the weight of processing, and it is also adjusted to contents of the rare earth fluoride and oxyfluoride is 1% by mass or less. Before leaching, the molten salt electrolysis residue is crushed previously into a particle diameter of 20 mm or less to obtain the coarse particles of the molten salt electrolysis residue and to increase a reaction interface with hydrochloric acid, thus the leaching efficiency can be enhanced.

Preferably, the obtained coarse particles of the molten salt electrolysis residue are washed with pure water, and then heated in the air at 400 to 600° C., to remove moisture, and graphite mixed from the anode by completely burning to remove as $CO_2$ gas. When the heating temperature is 400° C. or higher, the reaction rate of graphite can be increased, and a time required for complete combustion of graphite can be shortened. When the heating temperature is 600° C. or lower, melting of the coarse particles of the molten salt electrolysis residue can be suppressed. When the coarse particles of the molten salt electrolysis residue are molted, the molted molten salt electrolysis residue covers graphite, and as a result, the complete combustion of the graphite may be inhibited.

In the present invention, it is preferable that the preferably dried coarse particles of the molten salt electrolysis residue are mixed with a fluorinating material (for example, acidic ammonium fluoride ($NH_4FHF$)) and then the mixtures are heated. As a result, the coarse particles of the molten salt electrolysis residue can be fluorinated as shown by the following Formula (1) and Formula (2).

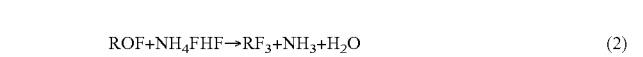

$$R_2O_3+3NH_4FHF \rightarrow 2RF_3+3NH_3+3H_2O \quad (1)$$

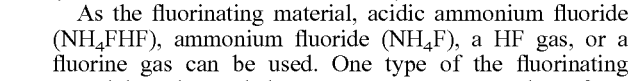

$$ROF+NH_4FHF \rightarrow RF_3+NH_3+H_2O \quad (2)$$

(wherein R is a rare earth element.)

As the fluorinating material, acidic ammonium fluoride ($NH_4FHF$), ammonium fluoride ($NH_4F$), a HF gas, or a fluorine gas can be used. One type of the fluorinating material can be used alone or two or more types thereof can be used in combination. The amount of the mixed fluorinating material varies depending on the amount of an oxide, a hydroxide, or an oxyfluoride contained in the coarse particles of the molten salt electrolysis residue, and it is not particularly limited. From the viewpoint of necessarily and sufficiently fluorinating the oxide and the oxyfluoride in the molten salt electrolysis residue, the amount of the mixed fluorinating material is typically 1.0 to 1.3 times, and preferably 1.05 to 1.2 times of the equivalent required for fluorination of the coarse particles of the molten salt electrolysis residue. From the viewpoint of necessarily and sufficiently advancing a fluorination reaction, the heating temperature is preferably 200 to 700° C., and more preferably 250 to 600° C. In order to prevent oxidation, the heating atmosphere is desirably an inert atmosphere such as Ar and $N_2$. In the fluorination reaction, heating under a HF gas flow can be adopted. In this case, a HF gas diluted with Ar can be used. The flow rate, the time, and the temperature can be appropriately selected according to the amount of oxygen in the molten salt electrolysis residue.

The oxygen concentration in the coarse particles of the fluorinated molten salt electrolysis residue is preferably 1.0% by mass or less from the viewpoint of well maintaining the yield of an alloy that is obtained by mixing the coarse particles with R, an R-M alloy, or an R-M-B alloy described below and heating and melting the mixture. The oxygen concentration in the fluorinated molten salt electrolysis residue increases depending on the condition of the fluorination process. Oxygen is bonded to a rare earth element in the R, the R-M alloy, or the R-M-B alloy during heating and melting, to form an oxide or an oxyfluoride. This lead to decrease the yield of the alloy.

The carbon concentration in the coarse particles of the fluorinated molten salt electrolysis residue is preferably 0.3% by mass or less from the viewpoint of using as a magnet raw material the alloy that is obtained by mixing the coarse particles with the R, the R-M alloy, or the R-M-B alloy described below and heating and melting the mixture. The carbon concentration in the molten salt electrolysis residue cannot be sufficiently decreased only by firing in the air described above. Therefore, by further performing a fluorination process, the carbon concentration in the molten salt electrolysis residue can be sufficiently decreased.

Since the separation coefficient between the alloy and slag after the heating and melting is small, the carbon concentration in the alloy obtained after the heating and melting is increased. Therefore, when the carbon concentration in the molten salt electrolysis residue is not sufficiently decreased, carbon is concentrated in a magnet raw alloy during recycling of the alloy to the magnet raw alloy, and the magnetic characteristics of a finally obtained magnet product are deteriorated.

In the present invention, the coarse particles of the fluorinated molten salt electrolysis residue are pulverized, and then heated and molten as a flux with the R, the R-M alloy, or the R-M-B alloy. In the heating and melting, a publicly known device, for example, a melting furnace capable of heating to a temperature equal to or higher than the melting points of the R, the R-M alloy, or the R-M-B alloy and the fluoride in an inert atmosphere, such as an arc melting furnace, a plasma melting furnace, or a high-frequency induction melting furnace, can be used.

Regarding as the R, the R-M alloy, or the R-M-B alloy, R, an R-M alloy, or an R-M-B alloy that is a typical initial raw material can be used, respectively. The R, the R-M alloy, or the R-M-B alloy may be waste generated in a step of producing a rare earth magnet, a sintered body produced in the step of producing a rare earth magnet, sludge generated in a step of processing a rare earth magnet or a workpiece obtained by firing the sludge, or a waste magnet collected from an applied product of a rare earth magnet. As the waste generated in the step of producing a rare earth magnet, for example, scrap materials generated in a molding step, a sintering step, or a machining step, solid scrap caused by a dimension or shape failure, a failure such as cracking or chipping, or faulty magnetic properties, grinding waste or sludge generated in a step of machining a rare earth magnet, or a workpiece obtained by firing the sludge, or the like can be used. A waste magnet collected from an applied product of a rare earth magnet can also be used similarly.

The composition of the waste generated in the step of producing a rare earth magnet can be represented by R, R-M, or R-M-B. R is one or more types of rare earth elements selected from the group consisting of Y, La, Ce, Nd, Pr, Sm, Gd, Dy, Tb, and Ho, M is a transition metal such as Fe and Co, and B is boron. In general, the content of R is 27 to 35% by weight, the content of B is 0.9 to 1.3% by weight, and the content of M is a balance. The waste generated in the step of producing a rare earth magnet is crushed in advance before melting. From the viewpoint of preventing oxidation during pulverization and preventing the waste from remaining unmolten, the shape thereof is preferably 5 mm or more.

The addition amount of the fluorinated molten salt electrolysis residue is preferably 5 to 50% by weight, and more preferably 10 to 30% by weight of the entire raw metals. From the viewpoint of maintaining a high yield of the alloy, the addition amount is preferably 5% by weight or more. An uncollected alloy forms a mixture with slag, and the mixture remains in a crucible. From the viewpoint of preventing erosion of an inner wall of the crucible caused by a reaction of the molten salt electrolysis residue with a crucible material and preventing adverse effects on magnetic properties and surface treatment characteristics of a sintered magnet caused by the molten salt electrolysis residue contamination which is caused by not sufficient separating, the addition amount is preferably 50% by weight or less. Apart of the fluorinated molten salt electrolysis residue can be partially replaced by the fluoride for an electrolysis raw material. From the viewpoint of decreasing a raw material cost, the replacement amount is preferably 50% by weight or less.

The coarse particles of the fluorinated molten salt electrolysis residue are grinded in advance with a hammer mill, a Braun mill, a jet mill, or the like into a powder of the molten salt electrolysis residue, and the powder is heated and molten as a flux. From the viewpoint of preventing contamination of the inside of the furnace caused by scattering during evacuation in the furnace, and preventing a decrease in yield due to not fully melting, and preventing a deterioration of magnetic properties and surface treatment characteristics of a sintered magnet due to contamination of impurity in the collected alloy, the average particle diameter of the powder is preferably 10 to 100 μm, and more preferably 20 to 80 μm. The average particle diameter of the powder of the fluorinated molten salt electrolysis residue refers to a value determined by a laser diffraction method through gas flow dispersion.

When the R, the R-M alloy, or the R-M-B alloy and the fluorinated molten salt electrolysis residue that is added as the flux are heated to a temperature equal to or higher than the melting point of the R, the R-M alloy, or the R-M-B alloy, a rare earth oxide ($R_2O_3$) contained in the R, the R-M alloy, or the R-M-B alloy and a rare earth fluoride ($RF_3$) that is a main component of the fluorinated molten salt electrolysis residue form a rare earth oxyfluoride (ROF) represented by the following Formula (3). Since the formed rare earth oxyfluoride (ROF) has a high melting point, it become slag. Since the density of the slag is lower than the density of a molten alloy, the slag can be separated from the molten alloy.

$$R_2O_3+RF_3 \rightarrow 3ROF \quad (3)$$

When the fluoride contains a larger amount of heavy rare earth element, the heavy rare earth element is selectively reduced by a reaction represented by the following Formula (4) and extracted into the alloy. A light rare earth element forms an oxyfluoride and can be separated as slag.

$$LR_2O_3+HRF_3+LR_{in\ R\text{-}M\text{-}B} \rightarrow 3LROF+HR \quad (4)$$

In Formula (4), HR is a heavy rare earth element, and LR is a light rare earth element.

This reaction is considered because an oxyfluoride of the light rare earth element is more stable phase thermodynamically than that of the heavy rare earth element, and the heavy rare earth element is more likely to form a stable intermetallic compound with a transition element than the light rare earth element. Therefore, the heavy rare earth element can be recycled as an alloy for a rare earth magnet raw material without a molten salt electrolysis step.

Since the rare earth oxide and the rare earth fluoride have a higher melting point and a lower density than the alloy, the rare earth oxide and the rare earth fluoride are contained in the slag. For this reason, an unreacted light rare earth oxide, an unreacted heavy rare earth fluoride, oxides of light rare earth element and heavy rare earth element obtained by extraction of the heavy rare earth element into the light rare earth oxide, fluorides of light rare earth element and heavy rare earth element obtained by extraction of the light rare earth element into the heavy rare earth fluoride are contained in the slag.

As an example, extraction of Dy into a Nd—Fe alloy wherein the heavy rare earth element in the fluorinated molten salt electrolysis residue is Dy and the R-M alloy is a Nd—Fe alloy will be described with reference to FIG. 2.

Figure 2:
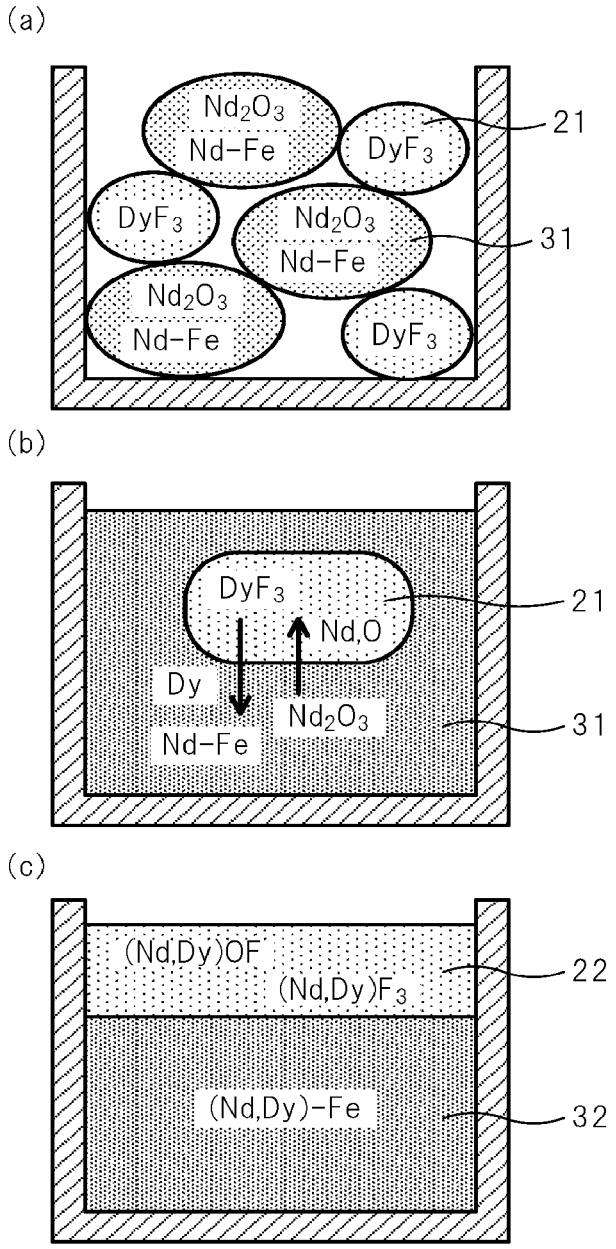
FIGS. 2(*a*) to 2(*c*) are conceptual views illustrating extraction of Dy in a molten salt electrolysis residue into a Nd—Fe alloy.

As shown in FIG. 2(*a*), a fluorinated molten salt electrolysis residue 21 containing Dy as a heavy rare earth element is added to a Nd—Fe alloy 31 as a flux. In the fluorinated molten salt electrolysis residue, Dy is present as $DyF_3$. The Nd—Fe alloy 31 contains $Nd_2O_3$ as an impurity.

The fluorinated molten salt electrolysis residue and the Nd—Fe alloy are heated to a temperature equal to or higher than the melting point of the Nd—Fe alloy. As a result, a rare earth oxide ($Nd_2O_3$) contained in the Nd—Fe alloy is reacted with a rare earth fluoride ($DyF_3$) that is a main component of the fluorinated molten salt electrolysis residue to form rare earth oxyfluorides ((Nd, Dy)OF) and rare earth fluorides ((Nd, Dy)$F_3$) as shown in FIG. 2(*b*). Since the produced rare earth oxyfluorides ((Nd, Dy)OF) and the produced rare earth fluorides ((Nd, Dy)$F_3$) have a higher melting point than a (Nd, Dy)—Fe alloy 32, the produced rare earth oxyfluorides ((Nd, Dy)OF) and the produced rare earth fluorides ((Nd, Dy)$F_3$) become slag 22 (see FIG. 2(*c*)).

The heavy rare earth element (Dy) is selectively reduced and extracted into the Nd—Fe alloy as shown in FIG. 2(*b*). As a result, the Nd—Fe alloy is converted to the (Nd, Dy)—Fe alloy 32 (see FIG. 2(*c*)). Using differences in specific gravity, the (Nd, Dy)—Fe alloy 32 can be separated from the slag 22 of the rare earth oxyfluorides ((Nd, Dy)OF) and the rare earth fluorides ((Nd, Dy)$F_3$).

The alloy obtained by the method for recycling a heavy rare earth element of the present invention can be reused as a raw alloy for a rare earth magnet after the inspection of a composition and an impurity concentration by ICP emission spectrometry and gas analysis. When a desired composition and a desired impurity concentration are obtained, the alloy is processed in accordance with a typical step of producing a magnet into a sintered magnet. For example, when the alloy obtained by the method for recycling a heavy rare earth element of the present invention is coarsely grinded by a hydrogenation and dehydrogenation process, finely pulverized in an inert gas atmosphere such as a nitrogen or argon gas (in particular, with a jet mill) such that the average particle diameter is 1 to 5 μm, molded in a magnetic field, sintered at 1,000 to 1,200° C. in vacuum or an inert atmosphere, cooled to 400° C. or lower, and then heat-treated at 400 to 600° C. in vacuum or an inert atmosphere, a sintered rare earth magnet can be obtained. Due to increase in coercive force of obtained sintered magnets, a grain-boundary diffusion process can be applied.

On the other hand, when the composition of the alloy obtained by the method for recycling a heavy rare earth element of the present invention is not a desired composition or the impurity concentration is more than a specified range, other prepared initial raw material can be blended, and then re-heating and re-melting mixed materials to obtain a desired alloy for a magnet raw material. As a casting method after heating and melting, a book molding method, a strip casting method, a melt spun method, or the like may be adopted.

EXAMPLES

Hereinafter, the present invention will be specifically described by Examples and Comparative Examples, but the present invention is not limited to the following Examples.

Examples 1 to 4 and Comparative Examples 1 and 2

A molten salt electrolysis step was performed using a graphite electrode as an anode, a Fe for a cathode, a mixed fluoride of $DyF_3$ (85% by weight)-LiF (15% by weight) as an electrolyte, and Dy oxide as a Dy raw material. A Dy—Fe alloy was produced. As a starting material, a molten salt electrolysis residue generated in the molten salt electrolysis step of Dy—Fe was used. The molten salt electrolysis residue was crushed with a hammer mill into 5 mm or less. Subsequently, a 1N hydrochloric acid aqueous solution was added, and the mixture was stirred for 4 hours and then washed with pure water. The molten residue was dried and fired at 600° C. in the air, $NH_4FHF$ was added as a fluorinating material, and the mixture was placed in a stainless container, and heated at 600° C. for 8 hours in an Ar atmosphere, resulting in fluorination. Values of composition analysis of coarse particles of the molten salt electrolysis residue before and after the fluorination are listed in Table 2. As shown in Table 2, the oxygen concentration and the carbon concentration are decreased to 1.0% by mass or less and 0.3% by mass or less, respectively. In the coarse particles of the molten salt electrolysis residue after the fluorination, $DyF_3$ produced by a reaction represented by the following Formula (5) was confirmed by an X-ray diffraction method (XRD).

$$DyOF+NH_4FHF \rightarrow DyF_3+NH_3+H_2O \quad (5)$$

In Table 2, $NdF_3$ for an electrolysis raw material that is used to produce a rare earth magnet raw material is also listed for reference.

TABLE 2

| Name | Flux | Dy (% by weight) | Nd (% by weight) | Fe (% by weight) | O (% by weight) | F (% by weight) | C (% by weight) |
|---|---|---|---|---|---|---|---|
| A | Molten salt electrolysis residue | 53.6 | 4.9 | 5.2 | 4.0 | 25.0 | 0.5 |
| B | Molten salt electrolysis residue after fluorination | 64.4 | 1.7 | 0.9 | 0.8 | 28.4 | 0.2 |
| C | (Reference) $NdF_3$ | — | 71.3 | <0.1 | 0.2 | 27.5 | <0.005 |

Figure 3:
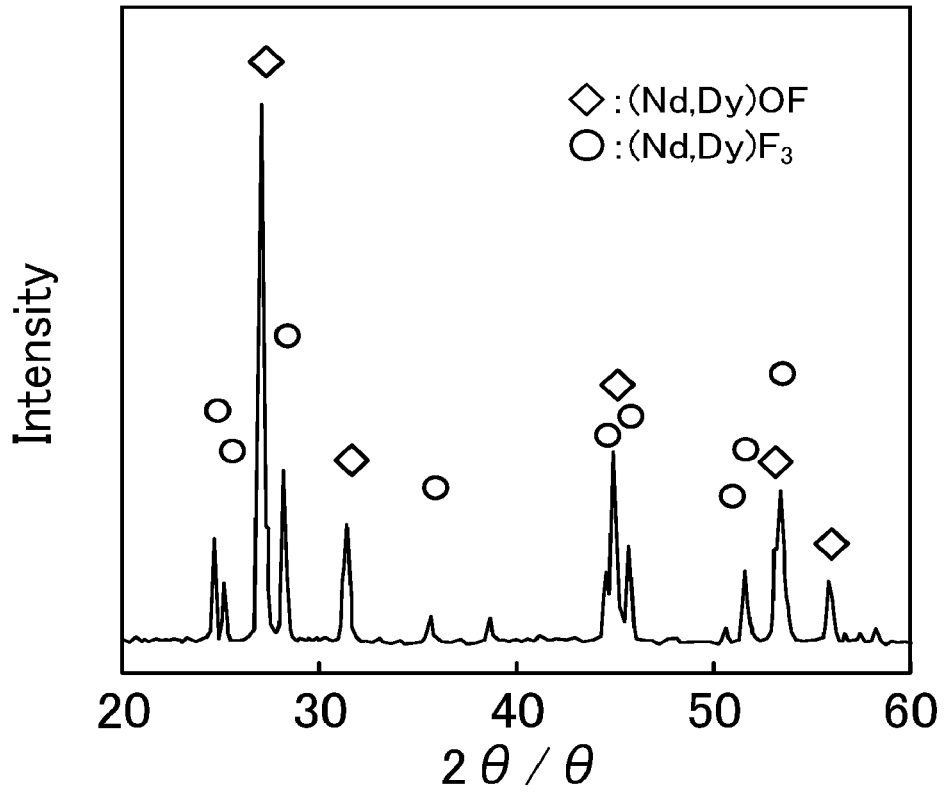
FIG. 3 is a result of XRD analysis of slag remaining in a crucible in Example 1.

Subsequently, the coarse particles of the fluorinated molten salt electrolysis residue were grinded with a hammer mill into an average particle diameter of 20 μm to obtain a powder of the fluorinated molten salt electrolysis residue, and the powder was charged with a rare earth magnet block in a high-frequency induction heating-melting furnace, and heated and molten at 1,400° C. or higher. After melting of the magnet block was confirmed, a crucible was tilted, and only a melt was cast in a Cu mold and collected as an R-M-B alloy. The yield of the alloy and results of composition analysis are listed in Tables 3 and 4. The composition was analyzed by high-frequency inductively coupled plasma atomic emission spectroscopy (ICP-AES). The results show Dy not contained in the rare earth magnet block can be extracted into the alloy. The Dy extraction rate was proportional to the addition amount of the powder of the fluorinated molten salt electrolysis residue. By addition of 10% or more of the powder of the fluorinated molten salt electrolysis residue, a Dy extraction rate was achieved to be 50% or more. As the result of XRD analysis with the slag remaining in the crucible, it is confirmed that the slag include unreacted fluoride and oxyfluoride as shown in FIG. 3.

TABLE 3

| | Weight of sintered Nd magnet block (g) | Type of flux | Weight of added flux (g) | Ratio of added flux (% by weight) | Weight of collected alloy (g) | Yield of alloy (% by weight) |
|---|---|---|---|---|---|---|
| Comparative Example 1 | 1045 | C | 106 | 10.2 | 999 | 95.6 |
| Comparative Example 2 | 1071 | A | 109 | 10.1 | 974 | 90.9 |
| Example 1 | 1059 | B | 106 | 10.0 | 1018 | 96.1 |
| Example 2 | 1008 | B | 154 | 15.3 | 999 | 99.1 |
| Example 3 | 1010 | B | 202 | 20.0 | 1000 | 99.0 |
| Example 4 | 1011 | B | 103 | 10.2 | 1003 | 99.2 |
| | | C | 100 | 9.9 | | |

TABLE 4

| | Type of flux | Nd + Pr (% by weight) | Dy (% by weight) | Fe + Co (% by weight) | B (% by weight) | O (% by weight) | C (% by weight) | Dy extraction rate (% by weight) |
|---|---|---|---|---|---|---|---|---|
| (Reference) sintered Nd magnet | — | 31.0 | 0.0 | 66.6 | 1.0 | 0.24 | 0.05 | — |
| Comparative Example 1 | C | 28.4 | 0.0 | 66.9 | 1.0 | 0.01 | 0.05 | 0 |
| Comparative Example 2 | A | 25.7 | 2.3 | 69.7 | 1.1 | 0.01 | 0.10 | 39 |
| Example 1 | B | 25.7 | 3.3 | 68.7 | 1.1 | 0.01 | 0.07 | 50 |
| Example 2 | B | 24.4 | 6.0 | 68.2 | 1.1 | 0.01 | 0.07 | 60 |
| Example 3 | B | 19.8 | 9.5 | 67.1 | 1.0 | 0.01 | 0.09 | 73 |
| Example 4 | B + C | 24.0 | 5.6 | 67.2 | 1.1 | 0.01 | 0.09 | 85 |

Example 5 and Comparative Example 3

With the powder of the molten salt electrolysis residue fluorinated in the same method as in Examples described above, Nd metal (purity: 99.6% by mass) was mixed, and the mixture was charged in a high-frequency induction heating-melting furnace, and heated and molten at 1,200° C. or higher. After melting of the Nd metal was confirmed, a crucible was tilted, only a melt was cast in a Cu mold, and a casting alloy was collected. The yield of the alloy and results of composition analysis are listed in Tables 5 and 6. As the results, Dy can be extracted into the alloy, and the extraction rate of Dy was achieved to be 69% or more.

TABLE 5

| | Electrolysis raw material | Type of flux | Weight of alloy (g) | Weight of added flux (g) | Ratio of added flux (% by weight) | Weight of collected alloy (g) | Yield of alloy (% by weight) |
|---|---|---|---|---|---|---|---|
| Example 5 | Nd metal | B | 48.4 | 10.5 | 21.7 | 47.6 | 98.3 |
| Comparative Example 3 | Nd metal | A | 47.3 | 10.5 | 22.3 | 41.8 | 88.4 |

TABLE 6

| | Type of flux | Nd (% by weight) | Dy (% by weight) | O (% by weight) | C (% by weight) | Dy extraction rate (% by weight) |
|---|---|---|---|---|---|---|
| Example 5 | B | 89.0 | 9.8 | 0.08 | 0.04 | 69 |
| Comparative Example 3 | A | 96.8 | 2.9 | 0.08 | 0.07 | 21 |

For all the raw materials used in Examples, raw materials recycled from industrial waste were used. Not only a production cost is decreased, but also the amount of generated waste is decreased and the energy amount for a treatment of the waste is decreased. Therefore, an environmental impact can be largely decreased.

REFERENCE SIGNS LIST

1 electrolysis vessel
2 deposited metal receiver vessel
3 deposited metal
4 molten salt
5 graphite anode
6 metal cathode
7 partition
21 fluorinated molten salt electrolysis residue
22 slag
31 Nd—Fe alloy
32 (Nd, Dy)—Fe alloy

The invention claimed is:

1. A method for collecting a heavy rare earth element from a heavy rare earth element-containing molten salt electrolysis residue and recycling the heavy rare earth element, the method comprising:

mixing coarse particles of the heavy rare earth element-containing molten salt electrolysis residue with a fluorinating material followed by firing, to fluorinate the coarse particles of the molten salt electrolysis residue;

grinding the coarse particles of the fluorinated molten salt electrolysis residue to obtain a powder of the fluorinated molten salt electrolysis residue; and mixing the powder of the fluorinated molten salt electrolysis residue with R, an R-M alloy, or an R-M-B alloy wherein R is one or more types of rare earth elements selected from the group consisting of Y, La, Ce, Nd, Pr, Sm, Gd, Dy, Tb, and Ho, Mis a transition metal selected from the group consisting of Fe and Co, and B is boron, heating and melting the mixture, separating a molten alloy from slag, and selectively extracting the heavy rare earth element into the molten alloy.

2. The method for recycling a heavy rare earth element according to claim 1, wherein the heavy rare earth element-containing molten salt electrolysis residue is one or more compounds selected from the group consisting of an oxide, a fluoride, and an oxyfluoride containing 50% by mass or more of one or more heavy rare earth elements selected from the group consisting of Dy and Tb.

3. The method for recycling a heavy rare earth element according to claim 1, wherein the fluorinating material is one or more fluorinating materials selected from the group consisting of $NH_4F$, $NH_4FHF$, a HF gas, and a fluorine gas.

4. The method for recycling a heavy rare earth element according to claim 1, wherein an oxygen concentration in the coarse particles of the fluorinated molten salt electrolysis residue is 1.0% by mass or less.

5. The method for recycling a heavy rare earth element according to claim 1, wherein a carbon concentration in the coarse particles of the fluorinated molten salt electrolysis residue is 0.3% by mass or less.

6. The method for recycling a heavy rare earth element according to claim 1, wherein the heating and melting is arc melting, plasma melting, or melting by high-frequency inductive heating.

7. The method for recycling a heavy rare earth element according to claim 1, wherein the powder of the fluorinated molten salt electrolysis residue has an average particle diameter of 10 to 100 μm that is obtained by a laser diffraction method through air flow dispersion.

8. The method for recycling a heavy rare earth element according to claim 1, wherein the R, the R-M alloy, or the R-M-B alloy is waste generated in producing a rare earth magnet.

9. The method for recycling a heavy rare earth element according to claim 1, wherein the R, the R-M alloy, or the R-M-B alloy is a sintered body generated in producing a rare earth magnet.

10. The method for recycling a heavy rare earth element according to claim 1, wherein the R, the R-M alloy, or the R-M-B alloy is sludge generated in processing a rare earth magnet or a workpiece obtained by firing the sludge.

11. The method for recycling a heavy rare earth element according to claim 1, wherein the R, the R-M alloy, or the R-M-B alloy is a waste magnet collected from an applied product of a rare earth magnet.

12. A method for recycling a rare earth magnet by using as a raw alloy for the rare earth magnet an alloy into which a heavy rare earth element is extracted by the method for recycling a heavy rare earth element according to claim 1.

* * * * *